US009103093B2

(12) United States Patent
Udagawa et al.

(10) Patent No.: US 9,103,093 B2
(45) Date of Patent: Aug. 11, 2015

(54) ROTATION CONTROL DEVICE OF WORKING MACHINE

(75) Inventors: Tsutomu Udagawa, Tsuchiura (JP); Mitsuo Sonoda, Tsuchiura (JP); Manabu Edamura, Tsuchiura (JP); Takenori Hiroki, Tsuchiura (JP); Manabu Sugiura, Tsuchiura (JP); Hidetoshi Satake, Tsuchiura (JP); Takako Satake, legal representative, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 140 days.

(21) Appl. No.: 13/980,607

(22) PCT Filed: Jan. 19, 2012

(86) PCT No.: PCT/JP2012/051098

§ 371 (c)(1),
(2), (4) Date: Oct. 1, 2013

(87) PCT Pub. No.: WO2012/099211

PCT Pub. Date: Jul. 26, 2012

(65) Prior Publication Data

US 2014/0032059 A1 Jan. 30, 2014

(30) Foreign Application Priority Data

Jan. 21, 2011 (JP) ..... 2011-011074

(51) Int. Cl.
*G06F 7/70* (2006.01)
*G06F 19/00* (2011.01)
(Continued)

(52) U.S. Cl.
CPC ..... *E02F 9/123* (2013.01); *E02F 9/2095* (2013.01)

(58) Field of Classification Search
CPC ..... E02F 9/123; E02F 9/2095; E02F 9/12
USPC ..... 701/50
See application file for complete search history.

(56) References Cited

U.S. PATENT DOCUMENTS

2005/0177292 A1* 8/2005 Okamura et al. ..... 701/50
2005/0253542 A1 11/2005 Sugano et al.

(Continued)

FOREIGN PATENT DOCUMENTS

JP 2003-33063 A 1/2003
JP 2003-328398 A 11/2003

(Continued)

OTHER PUBLICATIONS

International Search Report dated May 1, 2012 with partial English translation (five (5) pages).

*Primary Examiner* — Imran Mustafa
(74) *Attorney, Agent, or Firm* — Crowell & Moring LLP

(57) ABSTRACT

To automatically prevent a reverse movement by inhibiting an excessive increase in an output torque of an electric motor. A means (31) calculates a target value for a rotation speed based on a command from a system (20), a means (32) calculates a deviation between a detection value from a rotation speed sensor (81) and the target value, a means (33) calculates a first target torque in a direction that the deviation will be eliminated, and a means (34) calculates, based on a command from the system (20), a second target torque in the same direction as the target value. A means (50) calculates a variation in a rotation angle of an electric motor (12) in a first range, and a means (60) calculates the same variation in a second range. A means (40) calculates, based on the variations from the means (50, 60), a third target torque in a direction that the rotation angle will return to a rotation angle before a predetermined time (t), and a means (73) limits the first target torque to one of the second and third target torques, said one target torque being in the same direction as the first target torque and being greater in absolute value. Substantially an entirety of the first range specifies a range for the variation in one direction, a remaining small range specifies a range for the variation in the other direction, substantially an entirety of the second range specifies a range for the variation in the other direction, and a remaining small range specifies a range for the variation in the one direction.

1 Claim, 7 Drawing Sheets

(51) Int. Cl.

| | |
|---|---|
| ***G06G 7/00*** | (2006.01) |
| ***G06G 7/76*** | (2006.01) |
| ***E02F 9/12*** | (2006.01) |
| ***E02F 9/20*** | (2006.01) |

(56) References Cited

U.S. PATENT DOCUMENTS

| | | | | |
|---|---|---|---|---|
| 2008/0082240 | A1 * | 4/2008 | Kagoshima et al. | 701/50 |
| 2008/0164832 | A1 | 7/2008 | Kawaguchi et al. | |
| 2009/0320461 | A1 * | 12/2009 | Morinaga et al. | 60/431 |
| 2013/0197768 | A1 * | 8/2013 | Imura et al. | 701/50 |

FOREIGN PATENT DOCUMENTS

| | | | |
|---|---|---|---|
| JP | 2009-221664 | A | 10/2009 |
| WO | WO 2006/054582 | A1 | 5/2006 |
| WO | WO 2009/019826 | A1 | 2/2009 |

* cited by examiner

ROTATION CONTROL DEVICE OF WORKING MACHINE

TECHNICAL FIELD

This invention relates to a swing control system for a working machine. The swing control system is provided with a swing mechanism for driving an upperstructure by an output torque of an electric motor and a swing operating device for converting, upon selective operation thereof in one of opposite two directions, a direction and stroke of the operation to a swing command signal, and controls the electric motor based on the swing command signal from the swing operating device.

BACKGROUND ART

Conventional swing control systems for working machines include one arranged on a hydraulic excavator. This conventional swing control system is provided with a swing mechanism for driving an upperstructure by an output torque of an electric motor rotatable in opposite two directions, a swing operating device (control lever) selectively operable in opposite two directions from a neutral position and capable of converting a operation direction and operation stroke to a swing command signal, and a control means for controlling the electric motor based on the swing command signal from the swing operating device.

The control means is provided with a rotation speed detection means for detecting a rotation speed of the electric motor, a target rotation speed calculation means for calculating, based on the swing command signal from the swing operating device, a target rotation speed for the electric motor, a speed deviation calculation means for calculating a speed deviation of an actual rotation speed, which has been detected by the rotation speed detection means, relative to the target rotation speed, and a first target torque calculation means for calculating a target torque for the electric motor in a direction that the speed deviation calculated by the speed deviation calculation means will be eliminated. By these means, feedback control is performed on the rotation speed of the electric motor. As a result, in each of the opposite two directions of operation of the swing operating device from the neutral position, the swing speed of the upperstructure is controlled more as the operation stroke from the neutral position increases, and the swing speed of the upperstructure is controlled less as the operation stroke decreases.

Kinds of work performed by a hydraulic excavator includes pressing work. This pressing work is work that compacts and shapes an inner side wall of a ditch by pressing an outer side wall of a bucket of front working equipment against the inner side wall of the ditch. During this pressing work, the upperstructure does not turn, in other words, the actual rotation speed does not change from 0. Only with feedback control that controls the output torque of the electric motor to the target torque calculated by the first target torque calculation means, the output torque of the electric motor is, therefore, in a state that it is maintained at substantially the maximum irrespective of the operation stroke of the swing operating device. In this state, it is impossible to adjust the output torque of the electric motor in a direction that the bucket is pressed against the inner side wall of the ditch.

The control means is, therefore, provided with a second target torque calculation means for calculating, based on the swing command signal from the swing operating device, a target torque for the electric motor in the same direction as the target rotation speed, a detection means for detecting a state that the speed deviation has reached a predetermined value or greater, in other words, a state that pressing work has been started and turn has become stagnant, a switch means for automatically switching the control of the electric motor from a state, in which the control of the electric motor is performed based on the target torque calculated by the first target torque calculation means, to a state in which the control of the electric motor is performed based on the target torque calculated by the second target torque calculation means. During the pressing work, the output torque of the electric motor is controlled by these means based on the target torque calculated by the second target torque calculation means. As a result, in each of the opposite two directions of operation of the swing operating device from the neutral position, the output torque of the electric motor is controlled more as the operation stroke from the neutral position increases, and the output torque of the electric motor is controlled less as the operation stroke decreases. In other words, it has become possible to adjust the output torque of the electric motor in the direction that the bucket is pressed against the inner side wall of the ditch (see Patent Document 1).

PRIOR ART DOCUMENT

Patent Document

Patent Document 1: (JP2003-328398 Paragraph [0051])

DISCLOSURE OF THE INVENTION

Problem to be Solved by the Invention

In addition to the case that pressing work is performed as mentioned above, the stagnation of turn of the upperstructure also occurs when the bucket of the front working equipment is turned in air toward an ascending side on a sloping ground or when the front working equipment is turned against strong wind. In these two cases, there occurs not only the stagnation of turn but possibly also a reverse movement.

When turn becomes stagnant in the above-mentioned two cases, the above-described conventional swing control system is brought to a state that as in the time of pressing work, the output torque of the electric motor is controlled according to the operation stroke of the swing operating device. To prevent a reverse movement of the upperstructure in this state, it is necessary for an operator to adjust the operation stroke of the swing operating device from the neutral position such that at least the upperstructure stops against a wind force acting on the front working equipment.

With the above-mentioned circumstances in view, the present invention has as an object thereof the provision of a swing control system for a working machine, which can inhibit an excessive increase in the output torque of an electric motor due to the feedback control of a swing speed of an upperstructure and can automatically prevent a reverse movement.

Means for Solving the Problem

To achieve the above-mentioned object, a swing control system according to the present invention for a working machine is configured as will be described next.

[1] The swing control system according to the present invention for the working machine is characterized in that in a swing control system for the working machine, said swing control system being provided with a swing mechanism for driving an upperstructure by an output torque of an electric motor rotatable in opposite two directions, a swing operating device selectively operable in opposite two directions from a neutral position and capable of converting a operation direction and operation stroke to a swing command signal, and a control means for calculating, based on the swing command signal from the swing operating device, a target torque for the electric motor and controlling, based on the target torque, the output torque of the electric motor, the control means is provided with a rotation speed detection means for detecting a rotation speed of the electric motor, a target rotation speed calculation means for calculating, based on the swing command signal from the swing operating device, a target rotation speed for the electric motor, a speed deviation calculation means for calculating a speed deviation of an actual rotation speed, which has been detected by the rotation speed detection means, relative to the target rotation speed, a first target torque calculation means for calculating a first target torque in a direction that the speed deviation will be eliminated, a second target torque calculation means for calculating, based on the swing command signal from the swing operating device, a second target torque in the same direction as the target rotation speed, a first variation calculation means for calculating, based on a detection value of rotation speed by the rotation speed detection means, a variation in a rotation angle of the electric motor in a preset first calculation range, a second variation calculation means for calculating, based on the detection value of rotation speed by the rotation speed detection means, a variation in a rotation angle of the electric motor in a preset second calculation range, a third target torque calculation means for calculating, based on the variations calculated by the first and second variation calculation means, respectively, a third target torque in a direction that the rotation angle of the electric motor will return to a rotation angle before a predetermined time, and a target torque limitation means for limiting the first target torque to one of the second and third target torques, said one target torque being in the same direction as the first target torque and being greater in absolute value than the other target torque; substantially an entirety of the first calculation range specifies a calculation range for the variation in one of the two opposite directions of rotation of the electric motor, and a remaining calculation range other than the substantially the entirety of the first calculation range specifies a calculation range for the variation in the other direction; and substantially an entirety of the second calculation range specifies a calculation range for the variation in the other direction, and a remaining calculation range other than the substantially the entirety of the second calculation range specifies a calculation range for the variation in the one direction.

In the swing control system described above in [1] for the working machine, the rotation speed detection means detects an actual rotation speed of the electric motor, the target rotation speed calculation means calculates, based on a swing command signal from the swing operating device, a target rotation speed for the electric motor, the speed deviation calculation means calculates a speed deviation of the target rotation speed relative to the target rotation speed, and the first target torque calculation means calculates a first target torque for the electric motor in the direction that the speed deviation will be eliminated. Further, the second target torque calculation means calculates, based on the swing command signal from the swing operating device, a second target torque for the electric motor in the same direction as the target rotation speed. Furthermore, the first variation calculation means calculates, based on a detection value of rotation speed by the rotation speed detection means, a variation in the rotation angle of the electric motor in the first calculation range, and the second variation calculation means calculates, based on the detection value of rotation speed by the rotation speed detection means, a variation in the rotation angle of the electric motor in the second calculation range. The third target torque calculation means calculates, based on the variations calculated by the first and second variation calculation means, respectively, a third target torque in the direction that the rotation angle of the electric motor will return to a rotation angle before the predetermined time. The target torque limitation means then limits the first target torque to one of the second and third target torques, said one target torque being in the same direction as the first target torque and being greater in absolute value than the other target torque. As a consequence, it is possible to inhibit an excessive increase in the output torque of the electric motor due to the feedback control. Especially when the working machine is a hydraulic excavator, an operator can adjust the output torque of the electric motor according to the operation stroke of the swing operating device during pressing work. When the second target torque is insufficient for the prevention of a reverse movement, the third target torque which is greater in absolute value than the second target torque can be used as a limit value for the first target torque, whereby the automated prevention of the reverse movement of the upperstructure can be performed following the swing angle of the upperstructure.

In the swing control system described above in [1], substantially the entirety of the first calculation range specifies the calculation range for the variation in one direction, and the remaining calculation range other than the substantially the entirety specifies the calculation range in the other direction. Conversely, substantially the entirety of the second calculation range specifies the calculation range for the variation in the other direction, and the remaining calculation range other than the substantially the entirety specifies the calculation range for the variation in the one direction. Therefore, the first and second calculation ranges slightly include the calculation ranges in which values are opposite in sign to those in the calculation ranges specified by the substantial entireties, respectively. By using a third target torque calculated based on variations in these calculation ranges in which the values are opposite in sign, a reverse movement can be surely prevented.

[2] The swing control system according to the present invention for the working machine is characterized in that in a swing control system for a working machine, said swing control system being provided with a swing mechanism for driving an upperstructure by an output torque of an electric motor rotatable in opposite two directions, a swing operating device selectively operable in opposite two directions from a neutral position and capable of converting a operation direction and operation stroke to a swing command signal, and a control means for calculating, based on the swing command signal from the swing operating device, a target torque for the electric motor and controlling, based on the target torque, the output torque of the electric motor, the control means is provided with a rotation speed detection means for detecting a rotation speed of the electric motor, a target rotation speed calculation means for calculating, based on the swing command signal from the swing operating device, a target rotation speed for the electric motor, a speed deviation calculation means for calculating a speed deviation of an actual rotation speed, which has been detected by the rotation speed detection means, relative to the target rotation speed, a first target torque calculation means for calculating a first target torque in a direction that the speed deviation will be eliminated, a second target torque calculation means for calculating, based on the swing command signal from the swing operating device, a second target torque in the same direction as the target rotation speed, a swing angle detection means for detecting an actual swing angle of the upperstructure, a recording command means for commanding recording of the swing angle detected by the swing angle detection means, a swing angle recording means for storing, as a recorded swing angle, the swing angle commanded by the recording command means, an angle deviation calculation means for calculating an angle deviation of an actual swing angle, which has been detected by the swing angle detection means, relative to the recorded swing angle, a third target torque calculation means for calculating, based on the angle deviation, a third target torque in a direction that the upperstructure will be returned to the recorded swing angle, and a target torque limitation means for limiting the first target torque to one of the second and third target torques, said one target torque being in the same direction as the first target torque and being greater in absolute value than the other target torque.

The swing control system described above in [2] limits, like the control means in the swing control system described above in [1], the first target torque to one of the second and third target torques, said one target torque being in the same direction as the first target torque and being greater in absolute value than the other target torque. As a consequence, it is possible to inhibit an excessive increase in the output torque of the electric motor due to the feedback control.

The swing control system described above in [2] is different from the control means in the swing control system described above in [1] in that the swing angle recording means stores a record of a swing angle, which has been detected by the swing angle detection means, as a recorded swing angle according to a command from the recording command means, the angle deviation calculation means calculates an angle deviation of an actual swing angle relative to the recorded swing angle, and the third target torque calculation means calculates, based on the angle deviation, a third target torque in the direction that the upperstructure will be returned to the recorded swing angle. By controlling the output torque of the electric motor to the third target torque, the automated reverse movement prevention for the upperstructure can be performed on a reverse movement in a direction away from the recorded swing angle.

Advantageous Effects of the Invention

According to the present invention as described above in [1], it is possible to inhibit an excessive increase in the output torque of the electric motor due to the feedback control of the swing speed of the upperstructure, and also to perform the automated prevention of a reverse movement of the upperstructure by following the swing angle of the upperstructure.

According to the present invention as described above in [2], it is possible to inhibit an excessive increase in the output torque of the electric motor due to the feedback control of the swing speed of the upperstructure, and also to perform the automated reverse movement prevention for the upperstructure on a reverse movement in a direction away from a recorded desired swing angle (recorded swing angle).

MODES FOR CARRYING OUT THE INVENTION

First Embodiment

With reference to FIG. 1 through FIG. 6, a description will be made about a swing control system according to a first embodiment of the present invention for a working machine.

Figure 1:
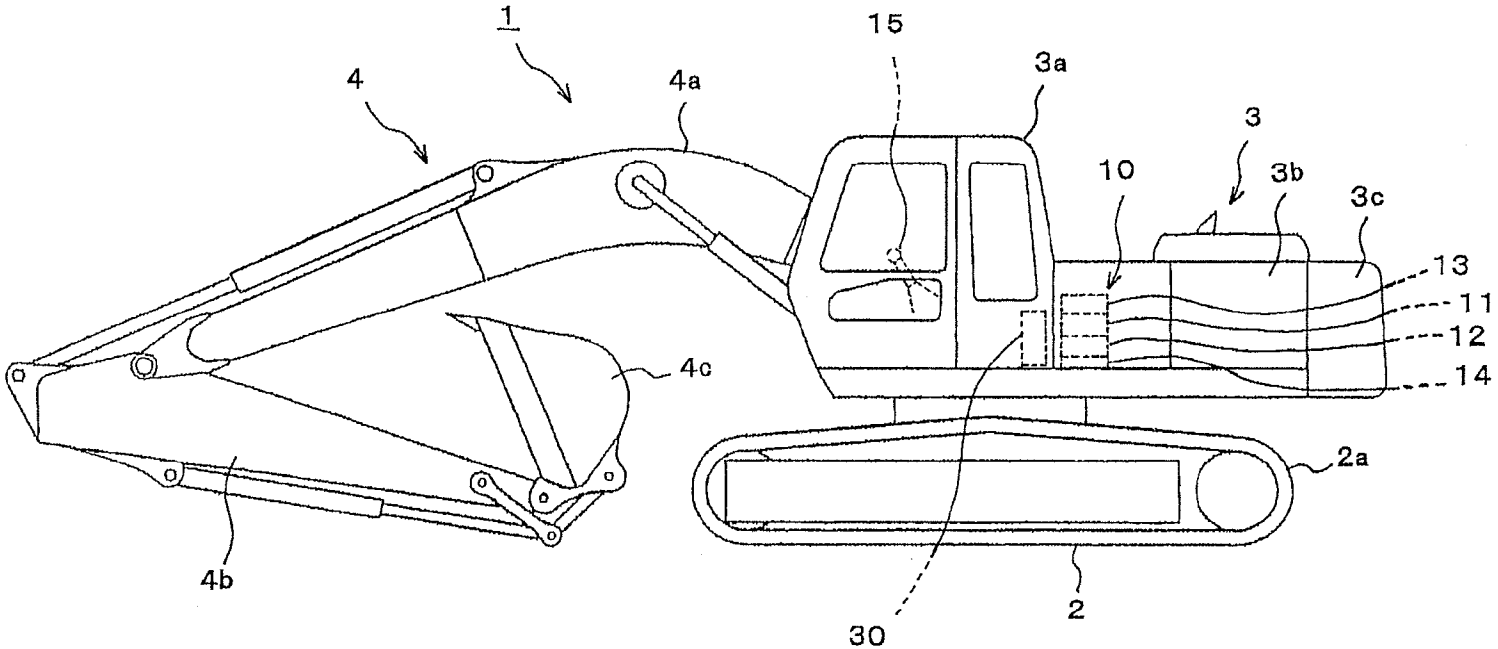
FIG. 1 is a side view of a hydraulic excavator as a working machine, on which a swing control system according to a first embodiment of the present invention is arranged.

As depicted in FIG. 1, a hydraulic excavator 1 has a undercarriage 2 capable of running by driving crawler tracks 2*a*, an upperstructure 3 connected to the undercarriage 2 via a swing bearing (not shown), and front working equipment 4 arranged on a substantially center of a front part of the upperstructure 3. The upperstructure 3 has an operator's cab 3*a* arranged laterally leftward of the front working equipment 4, a counterweight 3*c* forming a rear end part of the upperstructure 3, and an engine compartment 3*b* formed extending from a rear of the operator's cab 3*a* to the counterweight 3*c*. The front working equipment 4 is the backhoe type, and has a boom 4*a* connected tiltably in an up-and-down direction on the front part of the upperstructure 3, an arm 4*b* tiltably connected to the boom 4*a*, and a bucket 4*c* tiltably connected to the arm 4*b*.

The upperstructure 3 is drivable by a swing mechanism 10. This swing mechanism 10 is provided with a hydraulic motor 11 rotatable in opposite two directions, an electric motor 12 connected for transmission to the hydraulic motor 11 and rotatable in opposite two directions, a mechanical brake 13 for braking the hydraulic motor 11 and electric motor 12, and a reduction gear 14 connected for transmission to the electric motor 12. The mechanical brake 13 is a hydraulically-operated, wet multiplate device, and is a negative brake that braking is released by a brake release pressure applied when a command is made to the effect that the upperstructure 3 is to be turned or when actuation of the front working equipment is commanded. The reduction gear 14 is connected for transmission to a ring gear arranged on an inner peripheral wall of the above-described swing bearing (not shown). It is to be noted that the electric motor 12 functions as an electric generator during a deceleration of the upperstructure 3, whereby inertia energy of the upperstructure 3 is converted to electric energy. The electric energy generated by the electric motor 3 is stored in a battery (not shown).

In the operator's cab 3*a*, a swing operating device 15 is arranged. This swing operating device 15 is provided with a control lever 16 to be operated by an operator. This control lever 16 can be tiltingly operated selectively in opposite two directions, for example, left and right directions from a neutral position, and the swing operating device 15 converts, to a swing command signal (electrical signal), a operation direction and operation stroke of the control lever 16 from the neutral position. When the control lever 16 is tiltingly operated in one of left and right directions, specifically the left direction as viewed by the operator sitting in an operator's seat, there is produced a swing command signal that indicates the left direction as the operation direction and the operation stroke in the left direction from the neutral position at that time. When the control lever 16 is tiltingly operated in the right direction conversely, there is produced a swing command signal that indicates the right direction as the operation direction and the operation stroke in the right direction from the neutral position at that time.

In a rear part of the operator's cab 3*a*, a controller 30 is arranged. This controller 30 is provided with CPU (Central Processing Unit), ROM (Read Only Memory) with a control program and data stored therein, RAM (Random Access Memory) to be used as a work area for the CPU, an auxiliary storage device, and the like, and reads out the control program and data stored in the ROM or auxiliary storage device to perform processing for the control of the hydraulic excavator.

Figure 2:
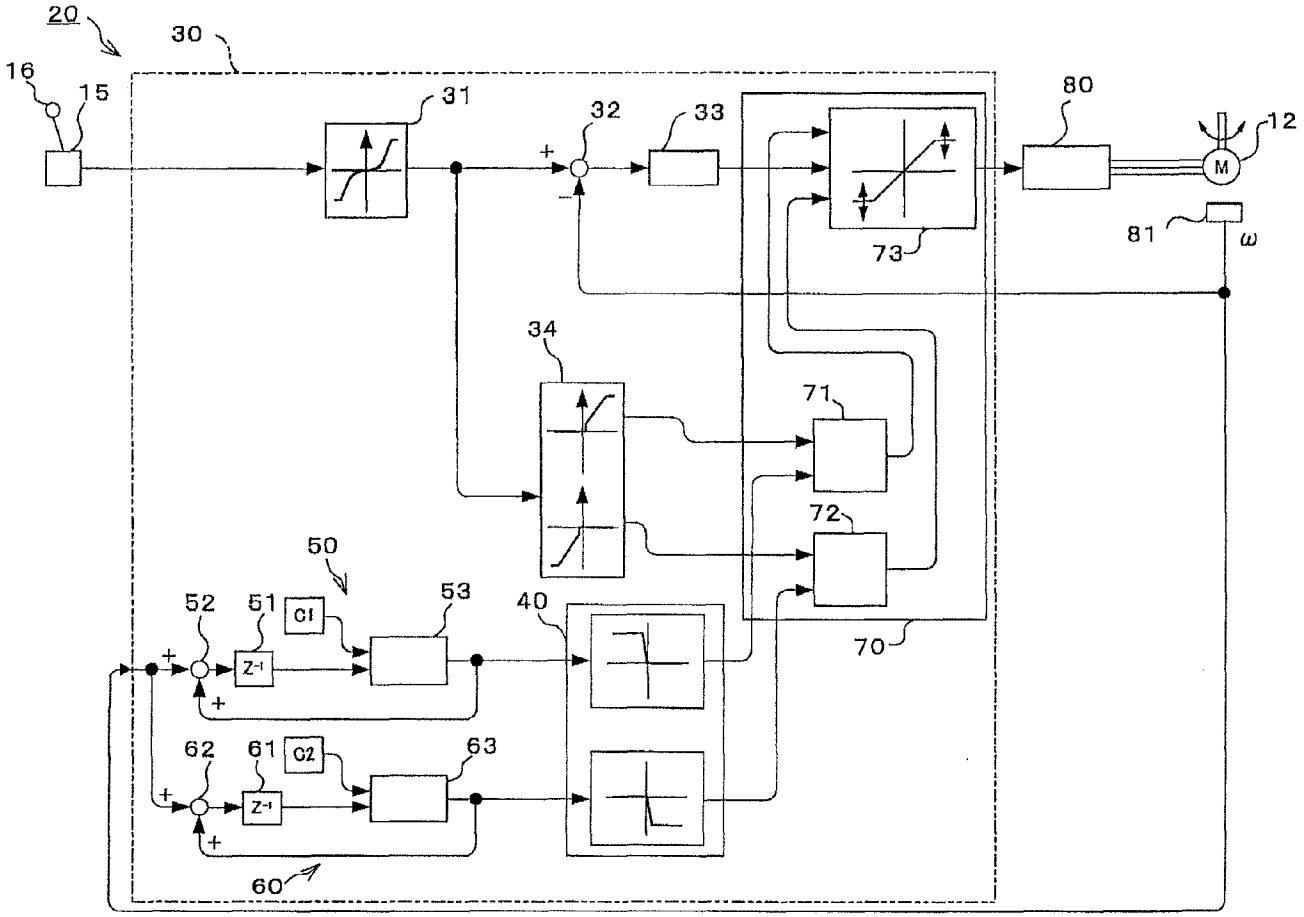
FIG. 2 is a block diagram showing the configuration of the swing control system according to the first embodiment of the present invention.

As shown in FIG. 2, in the controller 30, the swing operating device 15, a rotation speed sensor 81 as a rotation speed detection means for detecting a rotation speed ω of the electric motor 12, and an inverter 80 for controlling electric power to be fed from the battery to the electric motor 12 are electrically connected together. The rotation speed sensor 81 converts the rotation speed ω of the electric motor 12 to a rotation speed signal (electrical signal) and outputs it.

The controller 30 and rotation speed sensor 81 make up a control means for calculating a target torque for the electric motor 12 based on the swing command signal from the swing operating device 15 and controlling the output torque of the electric motor 12 based on the target torque.

The controller 30 is provided with a target rotation speed calculation means 31 for calculating a target rotation speed for the electric motor 12 based on the swing command signal from the swing operating device 15, a speed deviation calculation means 32 for calculating a speed deviation of an actual rotation speed ω, which has been detected by the rotation speed sensor 81, relative to the target rotation speed, and a first target torque calculation means 33 for calculating a first target torque in a direction that the speed deviation calculated by the speed deviation calculation means 32 will be eliminated. These means 31 to 33 have been set by the control program and data stored beforehand in the ROM or auxiliary storage device.

The target rotation speed calculation means 31 uses preset target rotation speed characteristics 31*a* (illustrated in FIG. 3) upon calculation of the target rotation speed for the electric motor 12 based on the swing command signal from the swing operating device 15. The target rotation speed characteristics 31*a* specify correlations between the operation direction (left/right direction) and operation stroke of the control lever 16 from the neutral position and the target rotation speed. In the target rotation speed characteristics 31*a*, a operation stroke in the left direction from the neutral position is expressed as a positive value, a operation stroke in the right direction from the neutral position is expressed as a negative value, a target rotation speed in a rotation direction (hereinafter called "the positive direction") corresponding to a left swing operation stroke is expressed as a positive value, and a target rotation speed in a rotation direction (hereinafter called "the negative direction") corresponding to a right turn is expressed as a negative value. A specific description will next be made about the correlations specified by the target rotation speed characteristics 31*a*.

Figure 3:
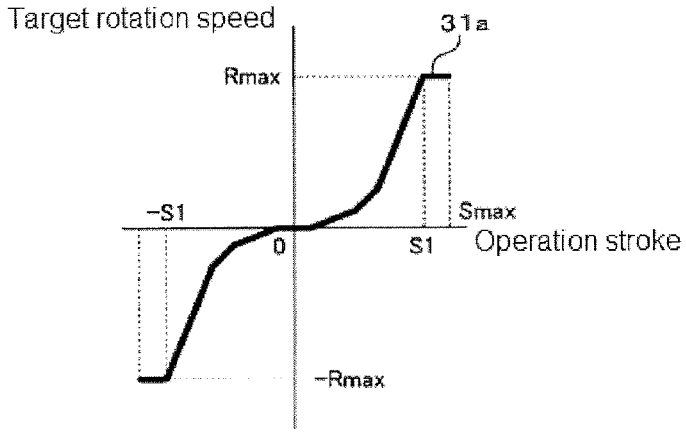
FIG. 3 is a diagram illustrating characteristics of a target rotation speed calculated by a target rotation speed calculation means shown in FIG. 2.

As illustrated in FIG. 3, the target rotation speed is 0 when the operation stroke is 0, in other words, the control lever 16 is at the neutral position. When the control lever 16 is operated in the left direction from the neutral position, the direction of the target rotation speed is a positive direction. The target rotation speed in the positive direction increases as the operation stroke in the left direction from the neutral position becomes greater. However, the target rotation speed in the positive direction reaches a maximum value Rmax when the control lever 16 is located close to a limit position of operation in the left direction and a little away from it toward the neutral position and the operation stroke has reached a predetermined operation stroke S1. Corresponding to a operation stroke in a range between a operation stroke Smax corresponding to the limit position of operation in the left direction and the predetermined operation stroke S1, the target rotation speed in the positive direction reaches the maximum value Rmax.

When the control lever 16 is operated in the right direction from the neutral position, the direction of the target rotation speed is a negative direction in contrast to the case in which the control lever is operated in the left direction from the neutral position. The absolute value of the target rotation speed in the negative direction increases as the operation stroke in the right direction from the neutral position becomes greater, in other words, the absolute value of the negative operation stroke increases. However, the target rotation speed in the negative direction reaches a minimum value −Rmax when the control lever 16 is located close to a limit position of operation in the right direction and a little away from it toward the neutral position and the operation stroke has reached a predetermined operation stroke −S1. Corresponding to a operation stroke in a range between a operation stroke −Smax corresponding to the limit position of operation in the right direction and the predetermined operation stroke −S1, the target rotation speed in the negative direction reaches the minimum value −Rmax.

The first target torque calculation means 33 calculates the first target torque in the same direction as the target rotation speed when the actual rotation speed ω is slower than the target rotation speed. The absolute value of the first target torque is calculated greater as the actual rotation speed ω becomes slower relative to the target rotation speed.

The controller 30 is further provided with a second target torque calculation means 34 for calculating, based on the swing command signal from the swing operating device 15, a second target torque in the same direction as the target rotation speed. This second target torque calculation means 34 has been set by the control program and data stored beforehand in the ROM or auxiliary storage device. This second target torque calculation means 34 uses preset first torque characteristics 34*a* (see FIG. 4A) and preset second torque characteristics 34*b* (see FIG. 4B) upon calculation of the second target torque based on the swing command signal from the swing operating device 15. These first torque characteristics 34*a* and second torque characteristics 34*b* specify correlations between the operation direction and operation stroke of the control lever 16 from the neutral position and the second target torque. A specific description will next be made about the correlations specified by these first torque characteristics 34*a* and second torque characteristics 34*b*.

Figure 4A:
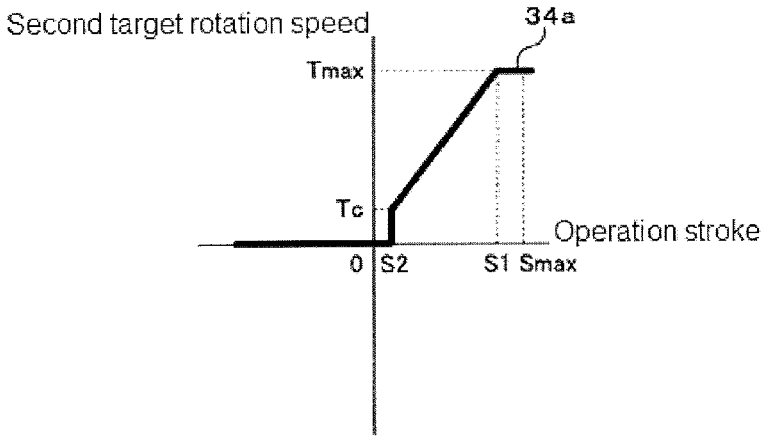
FIGS. 4A and 4B are diagrams illustrating characteristics of a second target torque calculated by a second target torque calculation means shown in FIG. 2.

As illustrated in FIG. 4A, the second target torque is 0 when the operation stroke is 0, in other words, the control lever 16 is at the neutral position. When the control lever 16 is operated in the left direction from the neutral position, the direction of the second target torque is a positive direction. The second target torque in the positive direction increases as the operation stroke in the left direction from the neutral position becomes greater. However, the second target torque is 0 in a range of from the operation stroke of 0 to less than a predetermined small operation stroke S2 in a proximity of 0. The second target torque is Tc when the operation stroke is the predetermined small operation stroke S2. The second target toque in the positive direction reaches a maximum value Tmax when the control lever 16 is located close to the limit position of operation in the left direction and a little away from it toward the neutral position and the operation stroke has reached the predetermined operation stroke S1. Corresponding to a operation stroke in the range between the control stroke Smax and the predetermined operation stroke S1, the second target torque in the positive direction reaches the maximum value Tmax. The maximum value Tmax is set at a maximum value of the output torque of the electric motor 12.

Figure 4B:
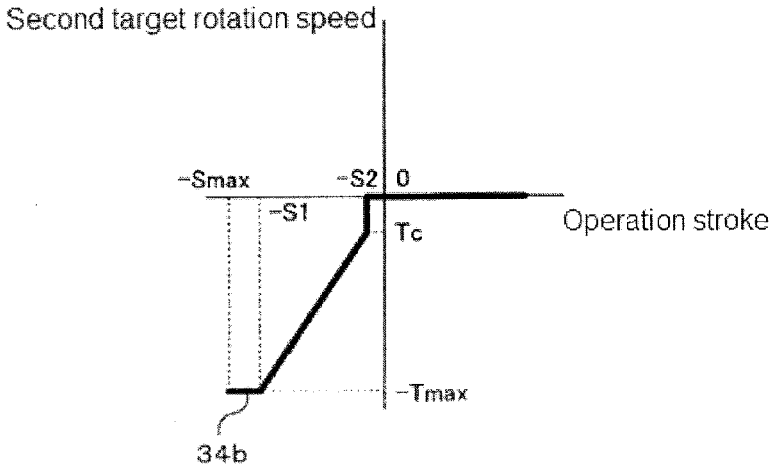

As illustrated in FIG. 4B, when the control lever 16 is operated in the right direction from the neutral position, the direction of the second target toque is a negative direction in contrast to the case in which the control lever 16 is operated in the left direction from the neutral direction. The absolute value of the second target torque in the negative direction increases as the operation stroke in the right direction from the neutral position becomes greater. However, the second target torque is 0 in a range of from the operation stroke of 0 to less than a predetermined small operation stroke −S2 in a proximity of 0. The second target toque reaches −Tc at the predetermined small operation stroke −S2. The second target torque in the negative direction reaches a minimum value −Tmax when the control lever 16 is located close to the limit position of operation in the right direction and a little away from it toward the neutral position and the operation stroke has reached a predetermined operation stroke −S1. Corresponding to a operation stroke between a operation stroke −Smax and the predetermined operation stroke −S1, the second target torque in the negative direction reaches the minimum value −Tmax.

The controller 30 is further provided with a first variation calculation means 50 for calculating a variation in the rotation angle of the electric motor 12 in a predetermined time t in a preset first calculation range, a second variation calculation means 60 for calculating a variation in the rotation angle of the electric motor 12 in the predetermined time t in a preset second calculation range, and a third target torque calculation means 40 for calculating, based on the variations calculated by the first variation calculation means 50 and second variation calculation means 60, respectively, a third target torque in a direction that the rotation angle of the electric motor 12 will return to a rotation angle before the predetermined time t. These means 50, 60, 40 have been set by the control program and data stored beforehand in the ROM or auxiliary storage device.

The first variation calculation means 50 is constructed, specifically including an addition means 52, a delay means (memory device) 51, and a selection means 53. The selection means 53 has an upper limit valve C1 stored beforehand therein, and performs a determination as to whether or not an added value obtained from the delay means 51 is not greater than the upper limit valve C. When a determination result that the added value is not greater than the upper limit valve C1 is obtained, the selection means 53 selects the added value as a value to be used in a computation by the third target torque calculation means 40. When a determination result that the added value is not equal to or smaller than the upper limit valve C1, in other words, a determination result that the added value is greater than the upper limit valve C1 is obtained, on the other hand, the selection means 53 does not select the added value but selects the upper limit valve C1 as a value to be used in the computation by the third target torque calculation means 40. The addition means 52 determines an added value of an output value from the selection means 53 and a detection value of the rotation speed from the rotation speed sensor 81. The delay means 51 temporarily stores and holds the added value, which has been inputted in the delay means 51, as a next input value to the selection means 53. The selection means 53 is set such that, in a state that no preceding value is stored in the delay means 51, neither a comparison with the upper limit valve C1 nor an output to the third target torque calculation means 40 is performed but the detection value of rotation speed from the rotation speed sensor 81 as inputted in the selection means 53 is outputted, as it is, to the addition means 52. It is configured that the processing by these addition means 52, delay means (memory device) 51 and selection means 53 at the first variation calculation means 50 is performed in a computation cycle of the predetermined time t.

The upper limit valve C1 is set for a positive variation, specifically for a variation in the rotation angle of the electric motor 12 in the positive direction as associated with a left turn. Concerning the first calculation range, substantially an entirety thereof specifies a calculation range for a negative variation, and a remaining calculation range other than substantially the entirety thereof specifies a calculation range for a positive variation which takes C1 as the upper limit valve. It is to be noted that no lower limit valve is set on a calculation range for a negative variation in the first calculation range.

The second variation calculation means 60 is constructed, specifically including an addition means 62, a delay means (memory device) 61, and a selection means 63. The selection means 63 has a lower limit valve C2 stored beforehand therein, and performs a determination as to whether or not an added value obtained from the delay means 61 is not smaller than the lower limit valve C2. When a determination result that the added value is not smaller than the lower limit valve C2 is obtained, the selection means 63 selects the added value as a value to be used in a computation by the third target torque calculation means 40. When a determination result that the added value is not equal to or greater than the lower limit valve C2, in other words, a determination result that the added value is smaller than the lower limit valve C2 is obtained, on the other hand, the selection means 63 does not select the added value but selects the lower limit valve C2 as a value to be used in the computation by the third target torque calculation means 40. The addition means 62 determines an added value of an output value from the selection means 63 and a detection value of rotation speed from the rotation speed sensor 81. The delay means 61 temporarily stores and holds the added value, which has been inputted in the delay means 61, as a next input value to the selection means 63. The selection means 63 is set such that, in a state that no preceding value is stored in the delay means 61, neither a comparison with the lower limit valve C2 nor an output to the third target torque calculation means 40 is performed but the detection value of rotation speed from the rotation speed sensor 81 as inputted in the selection means 63 is outputted, as it is, to the addition means 62. It is configured that the processing by these addition means 62, delay means (memory device) 61 and selection means 63 at the second variation calculation means 60 is performed in the computation cycle of the predetermined time t.

The lower limit valve C2 is set for a negative variation, specifically for a variation in the rotation angle of the electric motor 12 in the negative direction as associated with a right turn. Concerning the second calculation range, substantially an entirety thereof specifies a calculation range for a positive variation, and a remaining calculation range other than substantially the entirety thereof specifies a calculation range for a negative variation which takes C2 as the lower limit valve. It is to be noted that no upper limit valve is set on a calculation range for a positive variation in the second calculation range.

The third target torque calculation means 40 uses preset first anti-reverse movement characteristics 40*a* (see FIG. 5A) and preset second anti-reverse movement characteristics 40*b* (see FIG. 5B) upon calculation of the third target torque. The first anti-reverse movement characteristics 40*a* specify correlations between the negative variation in the rotation angle of the electric motor 12 in the predetermined time t and the third target torque. The second anti-reverse movement characteristics 40*b* specify correlations between the positive variation in the rotation angle of the electric motor 12 in the predetermined time t and the third target torque. A specific description will next be made about the correlations specified by these first anti-reverse movement characteristics 40*a* and second anti-reverse movement characteristics 40*b*.

Figure 5A:
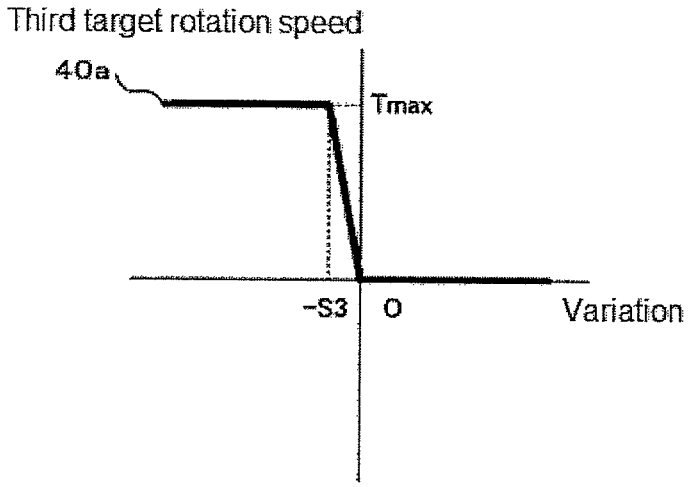
FIGS. 5A and 5B are diagrams illustrating characteristics of a third target torque calculated by a third target torque calculation means shown in FIG. 2.

As illustrated in FIG. 5A, the third target torque is 0 when the variation is 0 or a positive variation. For a negative variation, the direction of the third target torque is the positive direction. The maximum value of the third target torque in the positive direction is specified to be the maximum value Tmax of the output torque of the electric motor 12. Characteristics of the third target torque in a range of from 0 to the maximum value Tmax are defined by a linear function such that the third target torque in the positive direction increases as the absolute value of the negative variation becomes greater and the third target torque in the positive direction reaches the maximum value Tmax when the negative variation is a predetermined variation −S3. The predetermined variation −S3 has been set with an intention that a variation in the swing angle in the right direction, said variation corresponding to the predetermined variation −S3, is of such a small magnitude as being insensible by the operator, and is set, for example, to correspond to a swing angle of 1° in the right direction.

Figure 5B:
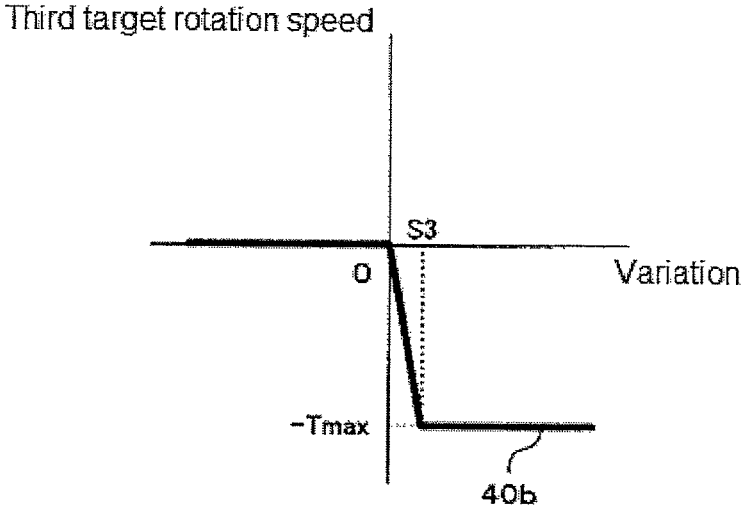

As illustrated in FIG. 5B, the third target torque is 0 when the variation is 0 or a negative variation. For a positive variation, the direction of the third target torque is the negative direction. The minimum value of the third target torque in the negative direction is specified to be −Tmax. Characteristics of the third target torque in a range of from 0 to the minimum value −Tmax are defined by a linear function such that the absolute value of the third target torque in the negative direction increases as the positive variation becomes greater and the third target torque in the negative direction reaches the minimum value −Tmax when the positive variation is a predetermined variation S3. The predetermined variation S3 has been set with an intention that a variation in the swing angle in the left direction, said variation corresponding to the predetermined variation S3, is of such a small magnitude as being insensible by the operator, and is set, for example, to correspond to a swing angle of 1° in the left direction.

The controller 30 is further provided with a target torque limitation means 70 for limiting the first target torque to one of the second and third target torques, said one target torque being in the same direction as the first target torque and being greater in absolute value than the other target torque. This target torque limitation means 70 has been set by the control program and data stored beforehand in the ROM or auxiliary storage device, and specifically, is provide with a left-turn target torque selection means 71, a right-turn target torque selection means 72, and a limit value determination means 73, all of which will be described next.

The left-turn target torque selection means 71 selects greater one of a second target torque calculated using the second torque characteristics 34*a* (illustrated in FIG. 4A) at the second target calculation means 34 and a third target torque calculated using the first anti-reverse movement characteristics 40*a* (illustrated in FIG. 5A) at the third target calculation means 40, or selects 0 when the second and third target torques are both 0.

The right-turn target torque selection means 72 selects greater one in absolute value of a second target torque calculated using the second torque characteristics 34*b* (illustrated in FIG. 4B) at the second target calculation means 34 and a third target torque calculated using the second anti-reverse movement characteristics 40*b* (illustrated in FIG. 5B) at the third target calculation means 40, or selects 0 when the second and third target torques are both 0.

The limit value determination means 73 selects, as a limit value for the first target torque, one of the target torque selected by the left-turn target torque selection means 71 and the target torque selected by the right-turn target torque selection means 72*a*, said one target torque being in the same direction as the first target torque. In other words, one of the second and third target torques is set at the upper limit valve for the first target torque when the first target toque is in the positive direction, and one of the second and third target torques is set at the lower limit valve for the first target torque when the first target toque is in the negative direction.

Figure 6:
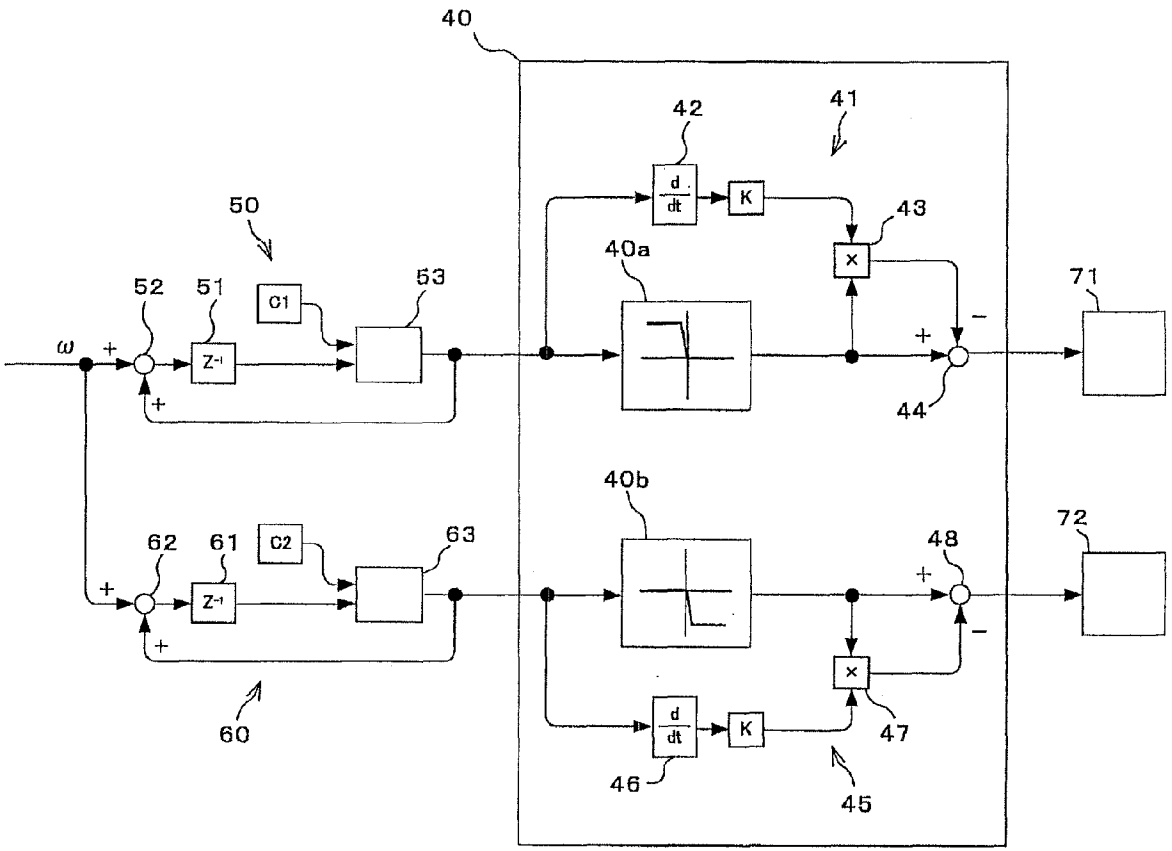
FIG. 6 is a block diagram showing a first and second correction means arranged in the third calculation means shown in FIG. 2.

As shown in FIG. 6, the third target torque calculation means 40 is provided with a first correction means 41 and second correction means 45, which upon control of the output torque of the electric motor 12 to the third target torque, perform a correction to decrease an overshoot in an output torque of the electric motor 12 according to the variation in the rotation angle of the electric motor 12 in the predetermined time t, specifically according to the absolute value of the third target torque.

The first correction means 41 is provided with a differentiator means 42, multiplier means 43 and subtractor means 44, and by these means, performs, based on a negative variation, correction processing by using a preset correction gain constant K to decrease an overshoot when the output torque of the electric motor 12 is controlled to the third target torque in the positive direction. By this correction processing, the degree of the decrease in the overshoot of the output torque of the electric motor 12 is set greater as the third target torque in the positive direction becomes greater.

The second correction means 45 is provided with a differentiator means 46, multiplier means 47 and subtractor means 48, and by these means, performs, based on a positive variation, correction processing by using the preset correction gain constant K to decrease an overshoot when the output torque of the electric motor 12 is controlled to the third target torque in the negative direction. By this correction processing, the degree of the decrease in the overshoot of the output torque of the electric motor 12 is set greater as the absolute value of the third target torque in the negative direction becomes greater.

Operation of the swing control system 20 according to the first embodiment configured as described above will be described by dividing it into the following three cases: (1) the upperstructure 3 is turned on a level ground with the front working equipment 4 being raised in windless air, (2) pressing work is performed by the hydraulic excavator 1, and (3) a reverse movement is prevented.

(1) Concerning the case in which the upperstructure 3 is turned on the level ground with the front working equipment 4 being raised in windless air, a description will be made by taking, as an example, a left turn of the upperstructure 3.

The operator operates the control lever 16 of the swing operating device 15 in the left direction from the neutral position, and maintains the operation stroke at a desired positive operation stroke of S2 or greater. In association with this, the swing control system 20 outputs a swing command signal. Upon input of the swing command signal to the controller 30, the target rotation speed calculation means 31 of the controller 30 calculates, based on the swing command signal, a target rotation speed in the positive direction. The speed deviation calculation means 32 of the controller 30 next calculates a speed deviation of an actual rotation speed ω, specifically 0 at the beginning of the turn as indicated by a rotation speed signal from the rotation speed sensor 81 relative to the target rotation speed in the positive direction, and as a result, obtains a speed deviation of the same magnitude as the target rotation speed in the positive direction. The first target torque calculation means 33 of the controller 30 then calculates, for example, the maximum value Tmax as a first target torque in a direction that the speed deviation will be eliminated, in other words, as a first target torque for accelerating a swing speed in the left direction.

On the other hand, the second target torque calculation means 34 of the controller 30 calculates a second target torque based on the swing command signal, and as a result, obtains the second target torque in the same direction as the target rotation speed, in other words, in the positive direction.

Shortly after the operation of the control lever 16 in the left direction, a resistance force caused by inertial forces, static friction forces and the like of the upperstructure 3 and front working equipment 4, each of which is in a stationary state, is acting on the electric motor 12. Therefore, the first variation calculation means 50 and second variation calculation means 60 of the controller 30 each calculate 0 as a variation in the rotation angle of the electric motor 12 in the predetermined time t. As a consequence, the third target torque calculation means 40 of the controller 30 calculates 0 as the third target torque by using the first anti-reverse movement characteristics 40*a*, and in parallel to this calculation, calculates 0 as the third target torque by using the second anti-reverse movement characteristics 40*b*.

In the target torque limitation means 70 of the controller 30, the left-turn target torque selection means 71 selects the second target torque in the positive direction because the third target torque is 0. On the other hand, the right-turn target torque selection means 72 selects 0 because the second and third target torques are both 0. Of the second target torque in the positive direction and 0 selected as described above, the limit value determination means 73 selects the second target torque in the positive direction, which is a target torque in the same positive direction as the first target torque. In other words, the upper limit valve for the first target torque in the positive direction is set at the second target torque in the positive direction. As the first target torque in the positive direction is at the maximum value Tmax and is greater than the second target torque in the positive direction, the controller 30 controls the inverter 80 such that the output torque of the electric motor 12 becomes the second target torque.

Because the upperstructure 3 is turned on the level ground with the front working equipment 4 being raised in windless air in this operation, an external force such as a reaction force from an inner side wall of a ditch during pressing work, a gravity component on a sloping ground or a wind force does not act on the front working equipment 4. Therefore, by the control of the output torque of the electric motor 12 to the first target torque in the positive direction or the second target torque in the positive direction as mentioned above, the electric motor 12 begins to rotate in the positive direction, in other words, the upperstructure 3 begins to turn in the left direction so that the speed deviation of the actual rotation speed ω relative to the target rotation speed becomes smaller. As a consequence, the first target torque in the positive direction also becomes smaller.

During the subsequent left turn of the upperstructure 3, the second target torque calculation means 34 continues to calculate the second target torque in the positive direction insofar as the control lever 16 remains operated in the left direction.

During the left turn of the upperstructure 3, the first variation calculation means 50 calculates, by the addition means 52 and delay means 51, a positive variation as the variation in the rotation angle of the electric motor 12 in the predetermined time t, and then, the selection means 53 selects the positive variation as a value to be used in the calculation of the third target torque when the positive variation is not greater than the upper limit valve C1, but selects the upper limit valve C1 as a value to be used in the calculation of the third target torque when the positive variation is greater than the upper limit valve C1. The third target torque calculation means 40 then calculates, based on the value selected by the selection means 53, the third target torque by using the first anti-reverse movement characteristics 40*a*. As this variation is a positive value, the third target torque calculated by using the first anti-reverse movement characteristics 40*a* is 0.

At the second variation calculation means 60, on the other hand, a positive variation is calculated by the addition means 62 and delay means 61 as at the first variation calculation means 50. This variation is a positive value greater than the lower limit valve C2. Therefore, the second variation calculation means 60 selects, by the selection means 63, the positive variation from the lower limit valve C2 and the positive variation as a value to be used in the calculation of the third target torque. The third target torque calculation means 40 then calculates, based on the value selected by the selection means 63, the third target torque in the negative direction by using the second anti-reverse movement characteristics 40*b*.

The left-turn target torque selection means 71 of the target torque limitation means 70 selects the second target torque in the positive direction as the third target torque is 0. The right-turn target torque selection means 72, on the other hand, selects the third target torque in the negative direction as the second target torque is 0. From these second target torque in the positive direction and the third target torque in the negative direction, the limit value determination means 73 selects the second target torque in the positive direction which is a target torque in the same direction as the first target torque. As a consequence, the controller 30 continues to control the inverter 80 such that the output torque of the electric motor 12 becomes the second target torque in the positive direction when the first target torque in the positive direction is greater than the second target torque in the positive direction. When the operator feels that an acceleration of the upperstructure 3 is insufficient in a state that the electric motor 12 is controlled at the second target torque in the positive direction, the second target torque can be increased by making greater the operation stroke of the control lever 16 in the left direction, and as a consequence, the acceleration of the upperstructure 3 can be increased.

With the output torque of the electric motor 12 being controlled at the second target torque in the positive direction, the rotation speed ω of the electric motor 12 increases, in other words, the swing speed of the upperstructure 3 in the left direction increases. As a consequence, the speed deviation of the actual rotation speed ω relative to the target rotation speed becomes still smaller. Accordingly, the first target torque in the positive direction also becomes still smaller. When the first target torque in the positive direction becomes equal to or smaller than the second target torque in the positive direction, the controller 20 controls the inverter 80 such that the output torque of the electric motor 12 becomes the first target torque.

(2) Concerning the case in which pressing work is performed by the hydraulic excavator 1, a description will be made by taking, as an example, a left turn of the upperstructure 3.

In this case, the controller 30 also controls, as in the case (1), the output torque of the electric motor 12 at the second target torque in the positive direction shortly after the control lever 16 has been operated to a desired positive operation stroke. As pressing work is performed this time, a reaction force acts on the bucket 4*c* of the front working equipment 4 from the inner side wall of the ditch, against which the bucket 4*c* is pressed in the left direction. As a consequence, the turn becomes stagnant, in other words, the actual rotation speed ω of the electric motor 12 does not become close to the target rotation speed. The first target torque in the positive direction is, therefore, maintained at the maximum value Tmax. When the operation stroke of the control lever 16 in the left direction is maintained, the second target torque in the positive direction remains unchanged. As the variation in the rotation angle of the electric motor 12 in the predetermined time t does not change either, the third target torque calculated by using the first anti-reverse movement characteristics 40*a* is 0 and the third target torque calculated by using the second anti-reverse movement characteristics 40*b* is also 0. The controller 20, therefore, controls the inverter 80 such that the output torque of the electric motor 12 becomes the second target torque, and as a consequence, the bucket 4*c* continues to be pressed against the inner side wall of the ditch.

In the state that the bucket 4*c* is pressed against the inner side wall of the ditch, the turn will remain stagnant even when the operator further operates the control lever 16 in the left direction to increase the positive operation stroke. The output torque of the electric motor 12 will, therefore, remain to be controlled at the second target torque. Because the second target torque increases as the positive operation stroke becomes greater but conversely decreases as the positive operation stroke becomes smaller, the operator can adjust the pressing force of the bucket 4*c* against the inner side wall of the ditch during pressing work by increasing or decreasing the operation stroke of the control lever 16 from the neutral position.

(3) Concerning the case in which a reverse movement is prevented, a description will be made by taking, as an example, the prevention of a reverse movement of the upperstructure 3 from a left turn.

The first and second target torques are calculated according to the operation stroke (positive stroke) of the control lever 16 in the left direction as described above in (1). The output torque of the electric motor 12 is controlled at the second target torque in the positive direction until the first target torque in the positive direction becomes equal to or smaller than the second target torque in the positive direction.

When the upperstructure 3 of the hydraulic excavator 1 standing on a sloping ground is turned toward the ascending side of the sloping ground, the gravity component of the front working equipment 4 acts as an external force against the turn. When the upperstructure 3 is turned upwind under strong wind, the wind force acts as an external force against the upperstructure. If the second target torque in the positive direction is too small relative to such an external force, the upperstructure 3, despite the operation of the control lever 16 in the left direction, turns in the right direction, in other words, moves in the right direction which is in the reverse direction, so that the electric motor 12 also rotates back in the negative direction together with the upperstructure 3.

Upon occurrence of the reverse movement, the first variation calculation means calculates, by the addition means 52 and delay means 51, a negative variation as a variation in the rotation angle of the electric motor 12 in the predetermined time t. This negative variation is smaller than the upper limit valve C1. Therefore, the first variation calculation means 50 selects, by the selection means 53, the negative variation from the negative variation and the upper limit valve C1 as a value to be used in the calculation of the third target torque. The third target torque calculation means 40 then calculates, based on the value selected by the selection means 53, the third target torque by using the first anti-reverse movement characteristics 40*a*, and as a consequence, obtains the third target torque in the positive direction.

The third target torque calculation means 40 also sets, based on the third target torque in the positive direction as calculated by using the first anti-reverse movement characteristics 40*a*, the degree of an overshoot in the output torque of the electric motor 12 by the first correction means 41.

As the second target torque in the positive direction becomes unduly smaller for the prevention of a reverse movement, the negative variation in the rotation angle of the electric motor 12 in the predetermined time t increases. Accordingly, the third target torque in the positive direction also increases to exceed the second target torque in the positive direction. As a consequence, the left-turn target torque selection means 71 selects the greater one of the second and third target torques in the positive direction, that is, the third target torque in the positive direction, and the limit value determination means 73 determines the third target torque in the positive direction as an upper limit valve for the first target torque. As a result, the output torque of the electric motor 12 is controlled to the third target torque in the positive direction, and the upperstructure 3 returns from the reverse movement.

It is to be noted that, when the negative variation in the rotation angle of the electric motor 12 in the predetermined time t has reached a value S3 corresponding to a swing angle of 1°, the third target torque in the positive direction reaches the maximum value Tmax, and therefore, the upperstructure 3 returns from the reverse movement while the swing angle of the reverse movement is smaller than 1°. As a consequence, the upperstructure 3 can be returned from the reverse movement without a moment for the operator to feel a discomfort or a deterioration in operability due to the reverse movement.

As the operation of the swing control system 20 upon performing a right turn of the upperstructure 3 is similar to the operation upon performing its left turn except for the difference that the directions of the first to third target torques become opposite directions (negative directions), the description of the operation is omitted herein.

By the swing control system 20 according to the first embodiment, the following advantageous effects can be obtained.

In the swing control system 20 according to the first embodiment, the target torque limitation means 70 limits the first target torque to one of the second and third target torques, said one target torque being in the same direction as the first target torque and being greater in absolute value than the other. As a result, the output torque of the electric motor 12 can be limited to the second target torque or third target torque when the absolute value of the first target torque is calculated to have an excessive magnitude due to the feedback control. As the output torque of the electric motor 12 is controlled at the second target torque especially during pressing work, the operator can adjust the output torque of the electric motor 12 according to the operation stroke of the control lever 16 of the swing control system 20. When the second target torque is insufficient for the prevention of a reverse movement, the third target torque which is greater in absolute value than the second target torque can be used as a limit value for the first target torque, thereby making it possible to automatically preventing the reverse movement.

In the swing control system 20 according to the first embodiment, substantially the entirety of the first calculation range specifies the calculation range for a variation in one direction, specifically a negative variation, and the remaining calculation range other than substantially the entirety thereof specifies a calculation range for a variation in the other direction, specifically a positive variation. Conversely to the foregoing, substantially the entirety of the second calculation range specifies the calculation range for a positive variation, and the remaining calculation range other than substantially the entirety thereof specifies the calculation range for a negative variation. Therefore, the first and second calculation ranges slightly include calculation ranges in which values are opposite in sign to those in the calculation ranges specified by the substantial entireties, respectively. By using the third target torque calculated based on variations in these calculation ranges in which the values are opposite in sign, a reverse movement can be surely prevented.

In the swing control system 20 according to the first embodiment, the third target torque calculation means 40 calculates, based on the variation in rotation angle as calculated by the first variation calculation means 50 and the variation in rotation angle as calculated by the second variation calculation means 60, the third target torque in the direction that the rotation angle will return to the rotation angle before the predetermined time t, and controls the output torque of the electric motor 12 at the third target torque. As a consequence, the automated prevention of a reverse movement of the upperstructure 3 can be performed following the swing angle of the upperstructure 3.

It is to be noted that in the above-described swing control system 20 according to the first embodiment, the first variation calculation means 50 and second variation calculation means 60 correspond to the first variation calculation means and second variation calculation means in the present invention and calculate, based on the detection value of rotation speed by the rotation speed sensor 81, the variation in rotation angle in the predetermined time t but the present invention is not limited to such an embodiment. The first variation calculation means and second variation calculation means may be changed to configurations that the variation of the rotation angle of the electric motor 12 in the predetermined time t is obtained by using a rotation angle detection means for detecting a rotation angle of the electric motor 12 and a subtractor means for subtracting a preceding rotation angle before the predetermined time t from the latest rotation angle detected by the rotation angle detection means, respectively.

Second Embodiment

Figure 7:
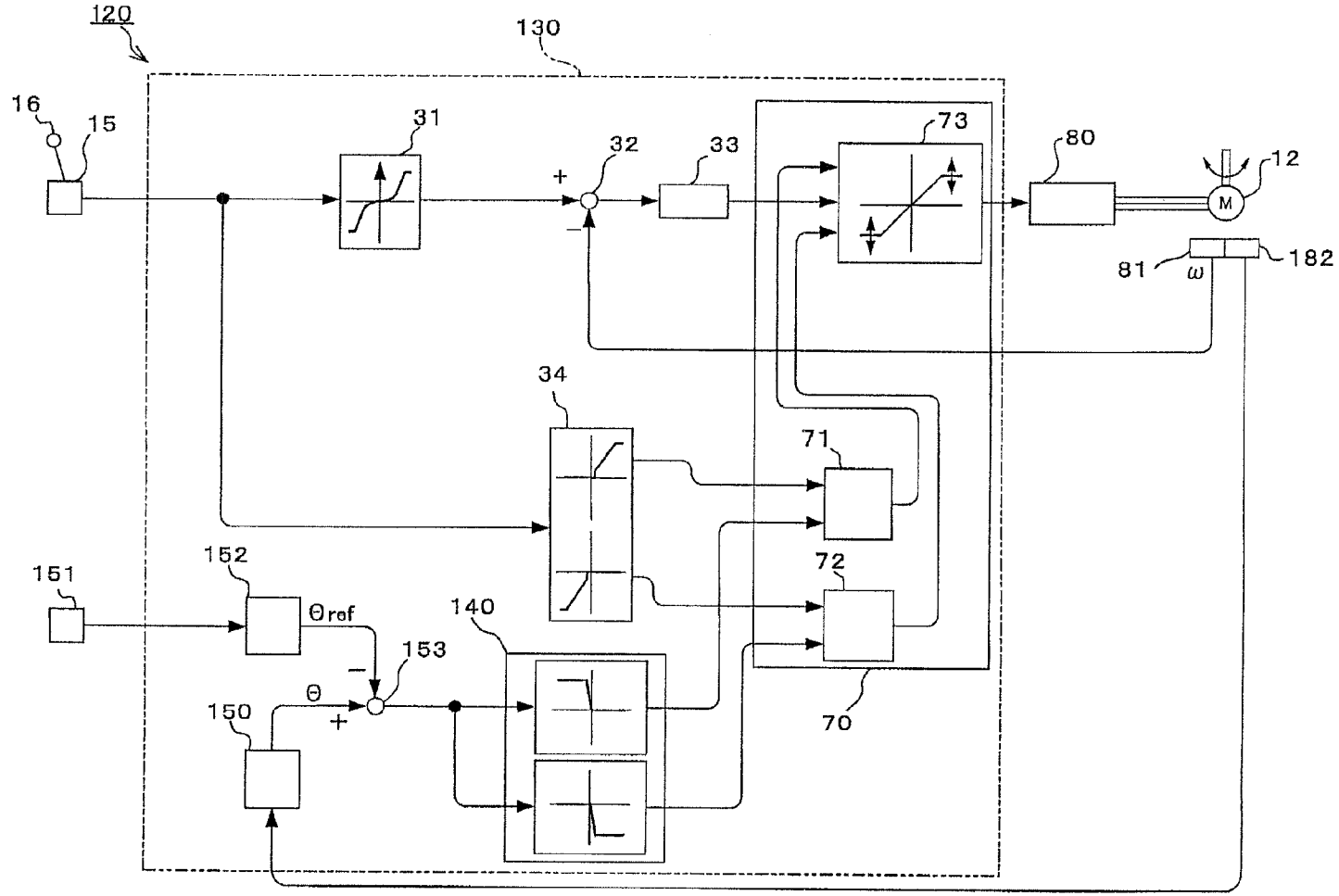
FIG. 7 is a block diagram showing the configuration of a swing control system according to a second embodiment of the present invention.
Figure 8:
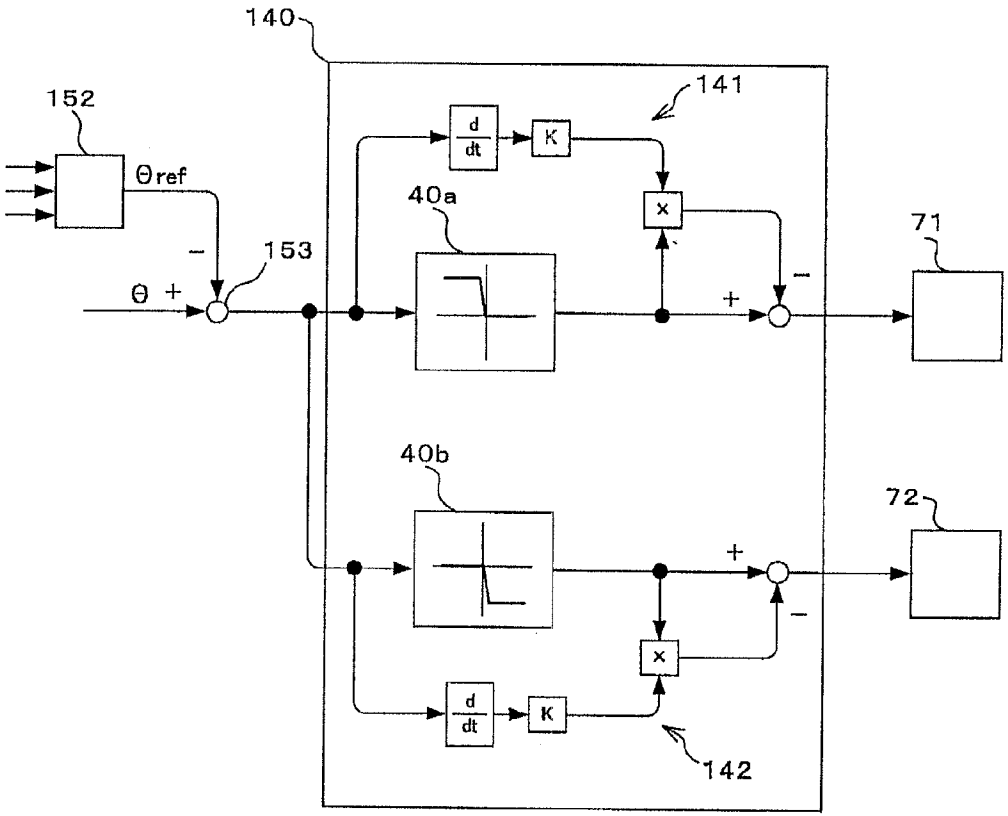
FIG. 8 is a block diagram showing a first and second correction means arranged in a third calculation means shown in FIG. 4.

With reference to FIG. 7 and FIG. 8, a description will be made about a swing control system according to a second embodiment of the present invention for a working machine.

As shown in FIG. 7, the swing control system 120 according to the second embodiment is provided with a rotation angle sensor 182 for detecting a rotation angle of the electric motor 12 and a swing angle calculation means 150 for calculating a swing angle θ of the upperstructure 3 based on the rotation angle detected by the rotation angle sensor 182. The swing angle calculation means 150 calculates, as a swing angle of 0°, a state that as shown in FIG. 1, the front working equipment 4 is directed in an advancing direction of the undercarriage 2 (see FIG. 1), calculates as a positive value a swing angle of from 0 to a predetermined limit angle smaller than 180° in the left direction, and calculates as a negative value a swing angle of from 0° to a predetermined limit angle smaller than 180° in the right direction. Further, this swing angle calculation means 150 has been set by a control program and data stored in a controller 130. It is to be noted that the rotation angle sensor 182 and swing angle calculation means 150 make up a swing angle detection means for detecting an actual swing angle of the upperstructure 3.

The controller 130, rotation speed sensor 81 and rotation angle sensor 182 make up a control means for calculating a target torque for the electric motor 12 based on a swing command signal from the swing operating device 15 and controlling the output torque of the electric motor 12 based on the target torque.

The swing control system 120 is further provided with a recording command means 151 for commanding recording of the swing angle detected by the swing angle sensor 182 and a single angle recording means 152 for storing the swing angle, which has been commanded by the recording command means 151, as a recorded swing angle θref. The recording command means 151 is a self-return pushbutton switch arranged at a location where the operator can operate the recording command means 151 in a position that the operator is in an operator's seat, for example, on a tip portion of the control lever 16. The swing angle recording means 152 stores the swing angle, which has been calculated by the swing angle calculation means 150, as the recorded swing angle θref when the recording command means 151 is push-operated, but erases the recorded swing angle θref when the recording command means 151 is push-operated again. This swing angle recording means 152 has been set by the control program and data stored in the controller 130.

The controller 130 is further provided with an angle deviation calculation means 153 for calculating an angle deviation of an actual swing angle θ relative to the recorded swing angle θref and a third target torque calculation means 140 for calculating, based on the angle deviation, a third target torque in a direction that the upperstructure 3 will be returned to the recorded swing angle θref. The angle deviation θ takes a positive value when the upperstructure 3 exceeds the recorded swing angle θref in a right turn, but takes a negative value when upperstructure 3 exceeds the recorded swing angle θref in a left turn.

The third target torque calculation means 140 uses preset first anti-reverse movement characteristics (not illustrated) and preset second anti-reverse movement characteristics (not illustrated) upon calculation of the third target torque. These first anti-reverse movement characteristics and second anti-reverse movement characteristics specify correlations between the angle deviation and the third target torque. A specific description will next be made about the correlations specified by these first anti-reverse movement characteristics and second anti-reverse movement characteristics.

The first anti-reverse movement characteristics are set to characteristics that the variations shown in FIG. 5A have been replaced to angle deviations. The third target torque is 0 when the angle deviation is 0 or a positive angle deviation. For a negative angle deviation, the direction of the third target torque is the positive direction. The maximum value of the third target torque in the positive direction is specified to be the maximum value Tmax of the output torque of the electric motor 12. Characteristics of the third target torque in a range of from 0 to the maximum value Tmax are defined by a linear function such that the third target torque in the positive direction increases as the absolute value of the negative angle deviation becomes greater and the third target torque in the positive direction reaches the maximum value Tmax when the negative angle deviation is a predetermined angle deviation. The predetermined negative angle deviation has been set with an intention that a variation in the swing angle in the left direction, which causes the predetermined negative angle deviation, is of such a small magnitude as being insensible by the operator, and is set, for example, to correspond to a swing angle of 1° in the left direction.

The second anti-reverse movement characteristics are set to characteristics that the variations shown in FIG. 5B have been replaced to angle deviations. Described specifically, the third target torque is 0 when the angle deviation is 0 or a negative angle deviation. For a positive angle deviation, the direction of the third target torque is the negative direction. The minimum value of the third target torque in the negative direction is specified to be −Tmax. Characteristics of the third target torque in a range of from 0 to the minimum value −Tmax are defined by a linear function such that the absolute value of the third target torque in the negative direction increases as the positive angle deviation become greater and the absolute value of the third target torque in the negative direction reaches the minimum value −Tmax when the positive angle deviation is a predetermined angle deviation. The predetermined positive angle deviation has been set with an intention that a change in the swing angle in the right direction, which causes the predetermined positive angle deviation, is of such a small magnitude as being insensible by the operator, and is set, for example, to correspond to a swing angle of 1° in the left direction.

As shown in FIG. 8, the third target torque calculation means 140 is provided with a first correction means 141 and second correction means 145, which upon control of the output torque of the electric motor 12 to the third target torque, perform a correction to decrease an overshoot in the output torque of the electric motor 12 according to the speed deviation when the output torque of the electric motor 12 is controlled to the third target torque.

The first correction means 141 is similar to the first correction means 41 in the first embodiment, and performs, based on a negative angle deviation, correction processing by using the preset correction gain constant K to decrease an overshoot when the output torque of the electric motor 12 is controlled to the third target torque in the positive direction. By this correction processing, the degree of the decrease in the overshoot of the output torque of the electric motor 12 is set greater as the third target torque in the positive direction becomes greater.

The second correction means 145 is also similar to the second correction means 45 in the first embodiment, and performs, based on a positive angle deviation, correction processing by using the preset correction gain constant K to decrease the overshoot when the output torque of the electric motor 12 is controlled to the third target torque in the negative direction. By this correction processing, the degree of the decrease in the overshoot of the output torque of the electric motor 12 is set greater as the absolute value of the third target torque in the negative direction becomes greater.

As is appreciated by referring to FIG. 7, the controller 130 of the swing control system 120 according to the second embodiment is provided, like the controller 30 in the swing control system 20 according to the first embodiment, with a configuration for calculating the first target torque and second target torque, such as the first target torque calculation means 33 and second target torque calculation mean 34, but is not provided with the first variation calculation means 50, second variation calculation means 60, selection means 53, 63, or third target calculation means 40.

Operation of the swing control system 120 according to the second embodiment configured as described above will be described by dividing it into the following three cases: (1) the upperstructure 3 is turned on a level ground with the front working equipment 4 being raised in windless air, (2) pressing work is performed by the hydraulic excavator 1, and (3) a reverse movement is prevented.

(1) Concerning the case in which the upperstructure 3 is turned on the level ground with the front working equipment 4 being raised in windless air, a description will be made by taking, as an example, a left turn of the upperstructure 3.

It is now assume, for example, that the recorded swing angle has already been set at −90° and the upperstructure 3 is standing at the recorded swing angle of −90°.

The operator operates the control lever 16 of the swing operating device 15 in the left direction from the neutral position in the above-described state, and maintains the operation stroke at a desired positive operation stroke of S2 or greater. In association with this, the swing operating device 15 outputs a swing command signal. Upon input of the swing command signal to the controller 130, the target rotation speed calculation means 31 of the controller 130 calculates, based on the swing command signal, a target rotation speed in the positive direction. The speed deviation calculation means 32 of the controller 130 next calculates a speed deviation of an actual rotation speed ω, specifically 0 at the beginning of the turn as indicated by a rotation speed signal from the rotation speed sensor 81 relative to the target rotation speed in the positive direction, and as a result, obtains a speed deviation of the same magnitude as the target rotation speed in the positive direction. The first target torque calculation means 33 of the controller 130 then calculates the maximum value Tmax as a first target torque in a direction that the speed deviation will be eliminated, in other words, as a first target torque for accelerating a swing speed in the left direction.

On the other hand, the second target torque calculation means 34 of the controller 130 calculates a second target torque based on the swing command signal, and as a result, obtains the second target torque in the same direction as the target rotation speed, in other words, in the positive direction.

Shortly after the operation of the control lever 16 in the left direction, a resistance force caused by inertial forces, static friction forces and the like of the upperstructure 3 and front working equipment 4, each of which is in a stationary state, is acting on the electric motor 12. Therefore, the actual swing angle θ calculated by the swing angle calculation means 150 remains at the recorded swing angle 90°, and therefore, the angle deviation calculation means 153 calculates 0 as an angle deviation. As a consequence, the third target torque calculation means 140 of the controller 130 calculates 0 as the third target torque by using the first anti-reverse movement characteristics, and in parallel to this calculation, calculates 0 as the third target torque by using the second anti-reverse movement characteristics.

In the target torque limitation means 70 of the controller 130, the left-turn target torque selection means 71 selects the second target torque in the positive direction because the third target torque is 0. On the other hand, the right-turn target torque selection means 72 selects 0 because the second and third target torques are both 0. Of the second target torque in the positive direction and 0 selected as described above, the limit value determination means 73 selects the second target torque in the positive direction, which is a target torque in the same positive direction as the first target torque. In other words, the upper limit valve for the first target torque in the positive direction is set at the second target torque in the positive direction. As the first target torque in the positive direction is at the maximum value Tmax and is greater than the second target torque in the positive direction, the controller 130 controls the inverter 80 such that the output torque of the electric motor 12 becomes the second target torque.

Because the upperstructure 3 is turned on the level ground with the front working equipment 4 being raised in windless air in this operation, an external force such as a reaction force from an inner side wall of a ditch during pressing work, a gravity component on a sloping ground or a wind force does not act on the front working equipment 4. Therefore, by the control of the output torque of the electric motor 12 to the second target torque in the positive direction as mentioned above, the electric motor 12 begins to rotate in the positive direction, in other words, the upperstructure 3 begins to turn in the left direction so that the speed deviation of the actual rotation speed ω relative to the target rotation speed becomes smaller. As a consequence, the first target torque in the positive direction also becomes smaller.

During the subsequent left turn of the upperstructure 3, the second target torque calculation means 34 continues to calculate the second target torque in the positive direction insofar as the control lever 16 remains operated in the left direction.

During the left turn of the upperstructure 3, the angle deviation calculation means 153 calculates the speed deviation in the position direction, so that the third target torque calculation means 140 calculates 0 as the third target torque by using the first anti-reverse movement characteristics, and in parallel to the above-described calculation, also calculated the third target torque in the negative direction by using the second anti-reverse movement characteristics.

The left-turn target torque selection means 71 of the target torque limitation means 70 selects the second target torque in the positive direction as the third target torque is 0. The right-turn target torque selection means 72, on the other hand, selects the third target torque in the negative direction as the second target torque is 0. From the second target torque in the positive direction and the third target torque in the negative direction selected as described above, the limit value determination means 73 selects the second target torque in the positive direction which is a target torque in the same direction as the first target torque. As a consequence, the controller 130 continues to control the inverter 80 such that the output torque of the electric motor 12 becomes the second target torque when the first target torque in the positive direction is greater than the second target torque in the positive direction. When the operator feels that an acceleration of the upperstructure 3 is insufficient in a state that the electric motor 12 is controlled at the second target torque in the positive direction, the second target torque can be increased by making greater the operation stroke of the control lever 16 in the left direction, and as a consequence, the acceleration of the upperstructure 3 can be increased.

With the output torque of the electric motor 12 being controlled at the second target torque in the positive direction, the rotation speed ω of the electric motor 12 increases, in other words, the swing speed of the upperstructure 3 in the left direction increases. As a consequence, the speed deviation of the actual rotation speed ω relative to the target rotation speed becomes still smaller. Accordingly, the first target torque in the positive direction also becomes still smaller. When the first target torque in the positive direction becomes equal to or smaller than the second target torque in the positive direction, the controller 120 controls the inverter 80 such that the output torque of the electric motor 12 becomes the first target torque.

(2) Concerning the case in which pressing work is performed by the hydraulic excavator 1, a description will be made by taking, as an example, a left turn of the upperstructure 3.

In this case, the controller 130 also controls, as in the case (1), the output torque of the electric motor 12 at the second target torque in the positive direction shortly after the control lever 16 has been operated to a desired positive operation stroke. As pressing work is performed this time, a reaction force against the left turn acts on the bucket 4*c* of the front working equipment 4 from the inner side wall of the ditch, against which the bucket 4*c* is pressed in the left direction. As a consequence, the turn becomes stagnant, in other words, the actual rotation speed ω of the electric motor 12 does not become close to the target rotation speed. The first target torque in the positive direction is, therefore, maintained at the maximum value Tmax. When the operation stroke of the control lever 16 in the left direction is maintained, the second target torque in the positive direction remains unchanged.

During the pressing work, the operator perform no recording of a swing angle. The calculation of the third target torque by the third target torque calculation means 140 is not performed accordingly. Therefore, the limit value determination means 73 selects the second target torque in the positive direction which is a target torque in the same positive direction as the first target torque. As a consequence, the bucket 4*c* continues to be pressed against the inner side wall of the ditch with the output torque of the electric motor 12 being controlled at the second target torque.

In the state that the bucket 4*c* is pressed against the inner side wall of the ditch, the turn will remain stagnant even when the operator further operates the control lever 16 in the left direction to increase the positive operation stroke. The output torque of the electric motor 12 will, therefore, remain to be controlled at the second target torque. Because the second target torque increases as the positive operation stroke becomes greater but conversely decreases as the positive operation stroke becomes smaller, the operator can adjust the pressing force of the bucket 4*c* against the inner side wall of the ditch during pressing work by increasing or decreasing the operation stroke of the control lever 16 from the neutral position.

(3) Concerning the case in which a reverse movement is prevented, a description will be made by taking, as an example, the prevention of a reverse movement of the upperstructure 3 from a left turn.

The first and second target torques are calculated according to the operation stroke (positive stroke) of the control lever 16 in the left direction as described above in (1). The output torque of the electric motor 12 is controlled at the second target torque in the positive direction until the first target torque in the positive direction becomes equal to or smaller than the second target torque in the positive direction.

When the upperstructure 3 of the hydraulic excavator 1 standing on a sloping ground is turned toward the ascending side of the sloping ground, the gravity component of the front working equipment 4 acts as an external force against the turn. When the upperstructure 3 is turned upwind under strong wind, the wind force acts as an external force against the upperstructure. If the second target torque in the positive direction is too small relative to such an external force, the upperstructure 3, despite the operation of the control lever 16 in the left direction, moves in the right direction which is in the reverse direction beyond the recorded swing angle, so that the electric motor 12 also rotates back in the negative direction together with the upperstructure 3.

Upon occurrence of a reverse movement, the angle deviation calculation means 153 calculates a negative speed deviation. The third target torque calculation means 140 calculates, based on the negative speed deviation, the third target torque by using the first anti-reverse movement characteristics, and as a consequence, obtains the third target torque in the positive direction, and also calculates the third target torque by using the second anti-reverse movement characteristics to obtain 0.

The third target torque calculation means 140 also sets, based on the third target torque in the positive direction as calculated by using the first anti-reverse movement characteristics 40*a*, the degree of an overshoot in the output torque of the electric motor 12 by the first correction means 141.

As the second target torque in the positive direction becomes unduly smaller for the prevention of a reverse movement, the angle deviation increases. Accordingly, the third target torque in the positive direction also increases to exceed the second target torque in the positive direction. As a consequence, the left-turn target torque selection means 71 selects the greater one of the second and third target torques in the positive direction, that is, the third target torque in the positive direction, and the limit value determination means 73 determines the third target torque in the positive direction as an upper limit valve for the first target torque. As a result, the output torque of the electric motor 12 is controlled to the third target torque in the positive direction, and the upperstructure 3 returns from the reverse movement.

It is to be noted that, when the angle deviation has reached a value corresponding to a swing angle of 1°, the third target torque in the positive direction reaches the maximum value Tmax, and therefore, the upperstructure 3 returns from the reverse movement while the swing angle of the reverse movement is smaller than 1°. As a consequence, the upperstructure 3 can be returned from the reverse movement without a moment for the operator to feel a discomfort or a deterioration in operability due to the reverse movement.

As the operation of the swing control system 120 upon performing a right turn of the upperstructure 3 is similar to the operation upon performing its left turn except for the difference that the directions of the first to third target torques become opposite directions (negative directions), the description of the operation is omitted herein.

By the swing control system 120 according to the second embodiment, the following advantageous effects can be obtained.

In the swing control system 120 according to the second embodiment, the target torque limitation means 70 limits the first target torque to one of the second and third target torques, said one target torque being in the same direction as the first target torque and being greater in absolute value than the other. As a result, the output torque of the electric motor 12 can be limited to the second target torque or third target torque when the absolute value of the first target torque is calculated to have an excessive magnitude due to the feedback control. As the output torque of the electric motor 12 is controlled at the second target torque especially during pressing work, the operator can adjust the output torque of the electric motor 12 according to the operation stroke of the control lever 16 of the swing operating device 15. When the second target torque is insufficient for the prevention of a reverse movement, the third target torque which is greater in absolute value than the second target torque can be used as a limit value for the first target torque, thereby making it possible to automatically preventing the reverse movement.

In the swing control system 120 according to the second embodiment, the third target torque calculation means 140 calculates, based on the angle deviation of the actual swing angle relative to the recorded swing angle, the third target torque, and controls the output of the electric motor 12 to the third target torque. As a consequence, the automated prevention of a reverse movement of the upperstructure 3 can be performed even when the reverse movement is in a direction away from the recorded desired swing angle (recorded swing angle).

In the swing control system 120 according to the second embodiment, the recording command means 151 is the pushbutton switch arranged, for example, on the tip portion of the control lever 16. However, the present invention does not limit the recording command means to such a pushbutton switch. A detection means may be arranged for detecting braking operation for the electric motor 12 by the mechanical brake 13, and by using this detection means as the recording command means, the detection of the braking operation may be used as a command for the recording of a swing angle.

Legend

1 Hydraulic excavator
3 Upperstructure
4 Front working equipment
10 swing mechanism
12 Electric motor
15 swing operating device
30 Controller
31 Target rotation speed calculation means
32 Speed deviation calculation means
33 First target torque calculation means
34 Second target torque calculation means
40 Third target torque calculation means
50 First variation calculation means
60 Second variation calculation means
70 Target torque limitation means
81 Rotation speed sensor
120 swing control system
130 Controller
140 Third target torque calculation means
150 swing angle calculation means
151 Recording command means
152 swing angle recording means
153 Angle deviation calculation means
182 Rotation angle sensor

The invention claimed is:

1. A swing control system for a working machine, said swing control system being provided with a swing mechanism for driving an upperstructure by an output torque of an electric motor rotatable in opposite two directions, a swing operating device selectively operable in opposite two directions from a neutral position and capable of converting a operation direction and operation stroke to a swing command signal, and a control means for calculating, based on the swing command signal from the swing operating device, a target torque for the electric motor and controlling, based on the target torque, the output torque of the electric motor, wherein:

the control means is provided with:

a rotation speed detection means for detecting a rotation speed of the electric motor, a target rotation speed calculation means for calculating, based on the swing command signal from the swing operating device, a target rotation speed for the electric motor, a speed deviation calculation means for calculating a speed deviation of an actual rotation speed, which has been detected by the rotation speed detection means, relative to the target rotation speed, a first target torque calculation means for calculating a first target torque in a direction that the speed deviation will be eliminated, a second target torque calculation means for calculating, based on the swing command signal from the swing operating device, a second target torque in the same direction as the target rotation speed, a first variation calculation means for calculating, based on a detection value of rotation speed by the rotation speed detection means, a variation in a rotation angle of the electric motor in a preset first calculation range, a second variation calculation means for calculating, based on the detection value of rotation speed by the rotation speed detection means, a variation in a rotation angle of the electric motor in a preset second calculation range, a third target torque calculation means for calculating, based on the variations calculated by the first and second variation calculation means, respectively, a third target torque in a direction that the rotation angle of the electric motor will return to a rotation angle before a predetermined time, and a target torque limitation means for limiting the first target torque to one of the second and third target torques, said one target torque being in the same direction as the first target torque and being greater in absolute value than the other target torque;

substantially an entirety of the first calculation range specifies a calculation range for the variation in one of the two opposite directions of rotation of the electric motor, and a remaining calculation range other than the substantially the entirety of the first calculation range specifies a calculation range for the variation in the other direction; and substantially an entirety of the second calculation range specifies a calculation range for the variation in the other direction, and a remaining calculation range other than the substantially the entirety of the second calculation range specifies a calculation range for the variation in the one direction.

* * * * *